US007565902B2

(12) United States Patent
Levin et al.

(10) Patent No.: US 7,565,902 B2
(45) Date of Patent: Jul. 28, 2009

(54) PAINTBALL MARKER CONVERSION UNIT

(75) Inventors: Ryan Scott Levin, Centerville, OH (US); Trent Alan Warncke, Lebanon, OH (US)

(73) Assignee: Levtec, LLC, Centerville, OH (US)

( * ) Notice: Subject to any disclaimer, the term of this patent is extended or adjusted under 35 U.S.C. 154(b) by 8 days.

(21) Appl. No.: 12/015,290

(22) Filed: Jan. 16, 2008

(65) Prior Publication Data

US 2008/0168973 A1 Jul. 17, 2008

Related U.S. Application Data

(60) Provisional application No. 60/885,102, filed on Jan. 16, 2007.

(51) Int. Cl.
*F41B 11/32* (2006.01)
*F41B 11/00* (2006.01)

(52) U.S. Cl. ..... 124/73; 124/71; 124/56

(58) Field of Classification Search ..... 124/56, 124/58, 61, 71, 73
See application file for complete search history.

(56) References Cited

U.S. PATENT DOCUMENTS

| | | | | |
|---|---|---|---|---|
| 2,605,756 | A * | 8/1952 | Bertschinger | 124/58 |
| 4,370,822 | A * | 2/1983 | Rabino | 42/106 |
| 5,503,137 | A * | 4/1996 | Fusco | 124/72 |
| 5,529,300 | A * | 6/1996 | Frazier et al. | 463/47.4 |
| 5,570,676 | A * | 11/1996 | Gore | 124/56 |
| 6,273,080 | B1 * | 8/2001 | Sullivan, Jr. | 124/84 |
| 6,637,420 | B2 * | 10/2003 | Moritz | 124/73 |
| 6,668,815 | B1 | 12/2003 | Fernandez | |
| 7,076,905 | B2 | 7/2006 | Zouboulakis | |
| 2005/0145235 | A1 * | 7/2005 | Jong | 124/73 |
| 2006/0180134 | A1 | 8/2006 | Illuzzi | |
| 2006/0231084 | A1 | 10/2006 | Styles et al. | |
| 2007/0028910 | A1 * | 2/2007 | Quinn et al. | 124/73 |
| 2007/0039601 | A1 * | 2/2007 | Jong | 124/73 |
| 2007/0144507 | A1 * | 6/2007 | Hu | 124/70 |
| 2007/0289586 | A1 * | 12/2007 | Tsurumoto | 124/73 |

* cited by examiner

*Primary Examiner*—Bret Hayes
(74) *Attorney, Agent, or Firm*—Wood, Herron & Evans, LLP

(57) ABSTRACT

A paintball marker conversion unit includes a projectile staging mechanism and adapter. The adapter couples the projectile staging mechanism to a conventional paintball marker with a particular barrel configuration. Different adapters can be used to couple the projectile staging mechanism to different conventional paintball markers with different barrel configurations. Thus, the projectile staging mechanism may coupled with various paintball markers provided a proper adapter is utilized to match a particular barrel configuration. The paintball marker conversion unit allows a conventional paintball marker to fire projectiles other than paintballs.

19 Claims, 13 Drawing Sheets

PAINTBALL MARKER CONVERSION UNIT

This application claims priority to U.S. Provisional Patent Application No. 60/885,102 filed on Jan. 16, 2007 and incorporates it by reference in its entirety.

FIELD OF THE INVENTION

This application relates to paintball markers and, more particularly, to a paintball marker conversion unit to allow a paintball marker to fire projectiles other than paintballs.

BACKGROUND OF THE INVENTION

Paintball markers are widely used in various recreational environments, such as simulated war games where the intent to shoot at an opposing player with a paintball, thus marking the opposing player with a particular paint color. Paintball markers using compressed air or gas for power are well known. Typically paintball markers are pneumatically powered, i.e., compressed air or gas powered, and mechanically operated markers are pneumatically powered.

Paintball markers are manufactured in a variety of shapes and sizes and have different types of internal mechanisms or actions therein. The internal mechanism or action is housed in a receiver of the marker. A magazine for holding a plurality of paintballs is connectable to the marker. Such markers include all elongated barrel, which extends from the receiver and from which the projectile is discharged, and a trigger housing connected to the receiver. The trigger housing carries a trigger mechanism, which includes a manually operated trigger for controlling the discharge of projectiles from the marker.

The sportsman that enjoys paintball markers may also have an interest in small caliber pneumatically powered projectile conveyors as well. The ammunition fired by a small caliber pneumatically powered projectile conveyors includes, but is not limited to, .177 caliber BBs, .177 caliber pellets, .25 caliber ball bearings, 6 mm airsoft rounds, and other small caliber ammunition. These various types of ammunition can be fired pneumatically, as well as mechanically. Because there is a plurality of small caliber ammunition that can be fired pneumatically, there arises a need for a universal device that can fire a wide range of projectiles pneumatically.

The sportsman wishing to use a small caliber, pneumatically powered, projectile conveyors has a need for the increased versatility of a device that can fire a plurality of types of projectiles.

SUMMARY OF THE INVENTION

In accordance with a first aspect of the invention, a paintball marker, a projectile staging mechanism, and an adapter comprise an apparatus able to fire a plurality of different types and sizes of projectiles. The paintball marker, which would have its standard barrel removed, includes a pneumatically-powered firing mechanism, and an input for receiving paintballs. The projectile staging mechanism, which receives and subsequently fires the plurality of different projectiles, attaches to the paintball marker in the place of the removed standard barrel. An adapter fits between the paintball marker and the projectile staging mechanism to mount or attach the paintball marker to the projectile staging mechanism.

In a specific embodiment, a paintball marker conversion unit includes a projectile staging mechanism having a barrel with a projectile inlet hole position along a sidewall of the barrel. The projectile staging mechanism has an attachment end. An adapter has first and second ends where the first end is selectively removeably coupled to the attachment end of the projectile staging mechanism and the second end is configured to selectively removeably couple to a paintball marker. The adapter further has a tube with a first end slideably engaging the barrel of the projectile staging mechanism and a second end configured to engage the paintball marker when the adapter is coupled to the paintball marker. When a trigger of the paintball marker is activated the tube moves forward to generally seal the projectile inlet hole and allow pressurized gas from the paintball marker to discharge the projectile out of the barrel.

The first and second ends of the adapter may be threaded. In addition, the adapter may include a retaining ring to rotatingly fix the adapter to the attachment end of the projectile staging mechanism. In so doing, the projectile staging mechanism can be fixed at a desired rotational angle relative to the paintball marker.

The projectile staging mechanism may include a magazine well for receiving and retaining a magazine suitable for holding projectiles. In that regard, the magazine well may include a magazine retaining mechanism that is selectively moveable to release a magazine retained in the magazine well. In one example, the magazine retaining mechanism includes a lever and oppositely disposed buttons. Either the lever or the two buttons may be operated to release a magazine from the magazine well.

In one embodiment of the paintball marker conversion unit the barrel has a first diameter and the tube has second diameter. The first diameter is greater than the second diameter such that the tube may slide inside of the barrel, such as when the projectile is fired out of the projectile staging mechanism. In another embodiment, the first diameter is less than the second diameter such that the tube slides over of the barrel such as when the projectile is fired out of the projectile staging mechanism.

In one embodiment, sometimes referred to as an indirect drive embodiment, the adapter includes a bias member, such as a spring, that is operatively couple to the tube so as to bias the tube toward the paintball marker. This arrangement creates an essentially airtight seal between the tube and paintball marker when the adapter is coupled to the paintball marker.

In another embodiment, sometimes referred to as an direct drive embodiment, the tube has a threaded end that couples to a bolt of the paintball marker when the adapter is coupled to the paintball marker. As such, the tube and bolt move together when the paintball marker is fired.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
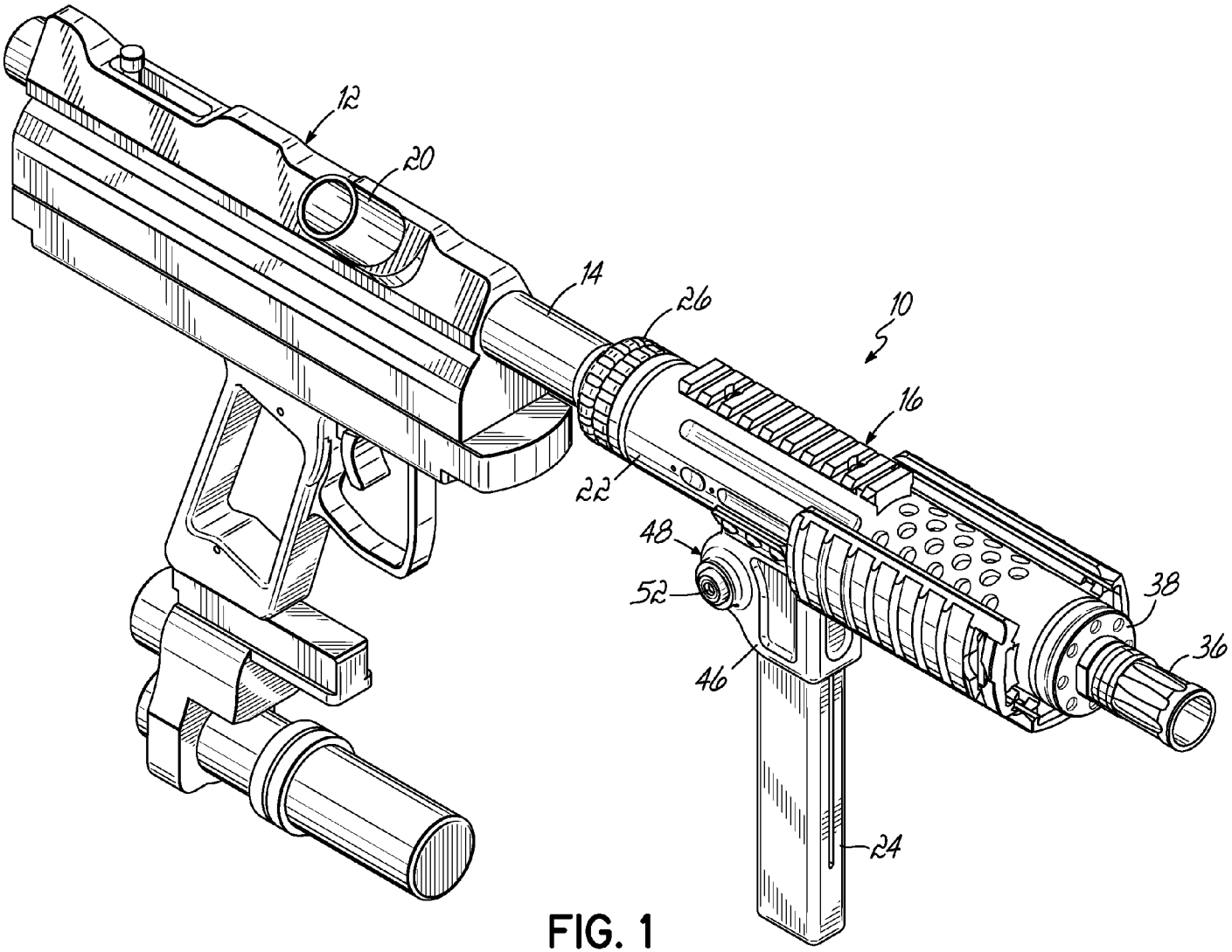
FIG. 1 is a perspective view of a paintball marker conversion unit mounted to conventional paintball marker.

Referring to FIG. 1, a paintball marker conversion unit 10 is mounted to a conventional paintball marker 12 from an original equipment manufacturer. To mount the paintball marker conversion unit 10 to the paintball marker 12, the stock barrel (not shown) that came with the conventional paintball marker 12 is unscrewed and in its place an adapter 14 is screwed in. The paintball marker conversion unit 10 includes a projectile staging mechanism 16 that screws onto the other end of the adapter 14. Paintball marker 12 has a firing mechanism, which includes a bolt 18 (FIG. 2) that is activated by compressed gas to fire projectiles. Typically, paintballs are fed to the paintball marker 12 through projectile port 20. With the adapter 14 and projectile staging mechanism 16 in place, the projectiles are fed directly into projectile staging mechanism 16 instead of through projectile port 20.

The projectile staging mechanism 16 can be coupled to a wide variety of conventional paintball markers—and not just those shown and described herein—so long as the appropriate adapter 14 is used. Because both ends of the adapter 14 are threaded, it is a relatively quick and easy process to couple and uncouple the projectile staging mechanism 16 to different paintball markers. In the end, the consumer needs to purchase only different adapters 14, instead of different projectile staging mechanisms 16, if he or she desires to utilize a different paintball marker 12. Although the ends of adapter 14 are shown and described has being threaded, the ends of the adapter 14 may alternatively have other ways of connecting to the projectile staging mechanism 16 and the paintball marker 12. By way of example, but not limitation, the ends may have quick disconnect mechanisms similar to those used on pneumatic tools. Such an arrangement would permit the operator to quickly disconnect one paintball marker 12 from the adapter 14 and attached a different paintball marker 12 without using any tools.

Figure 2:
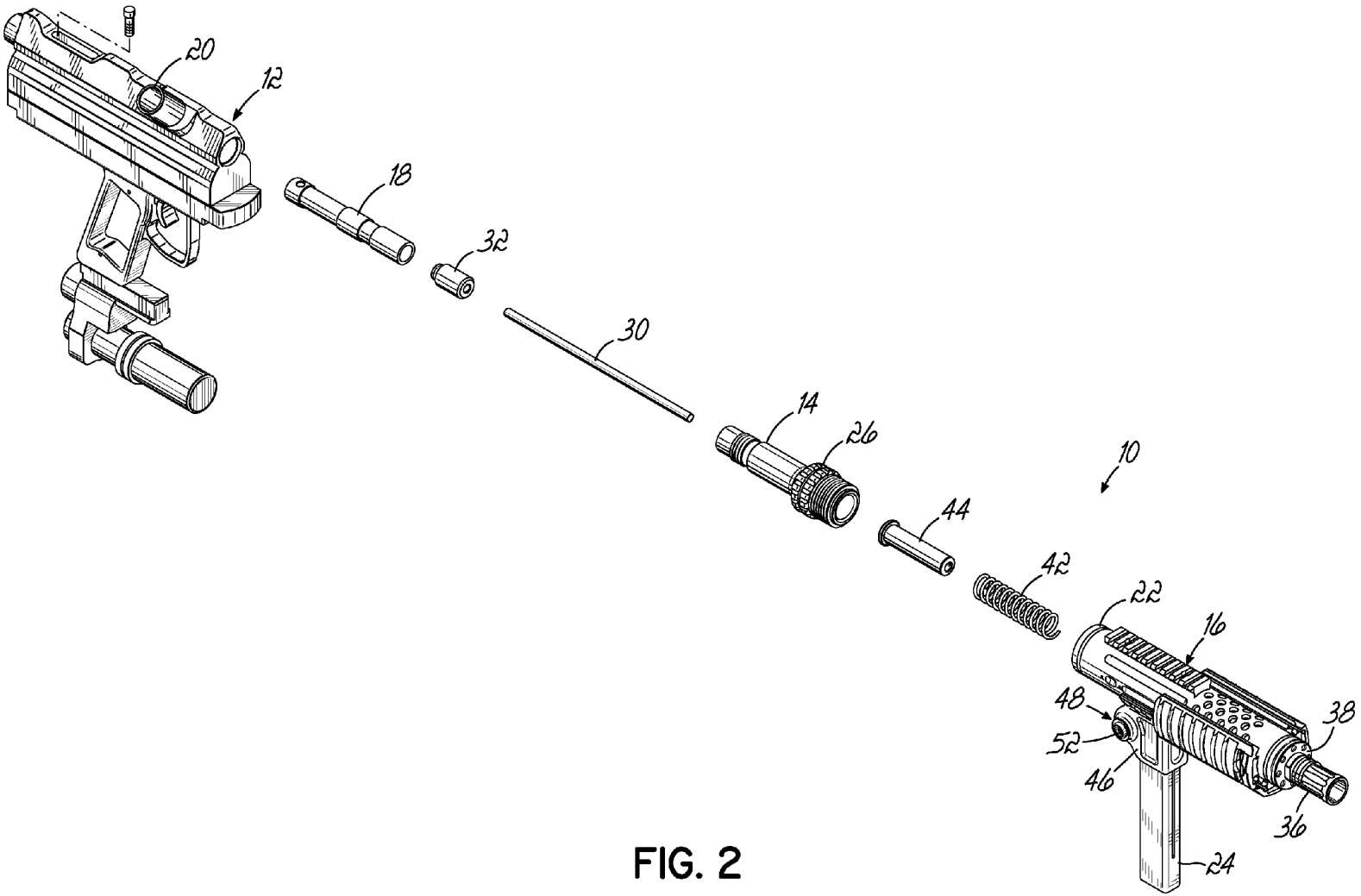
FIG. 2 is a disassembled perspective view of the paintball conversion unit and conventional paintball marker of FIG. 1.
Figure 3A:
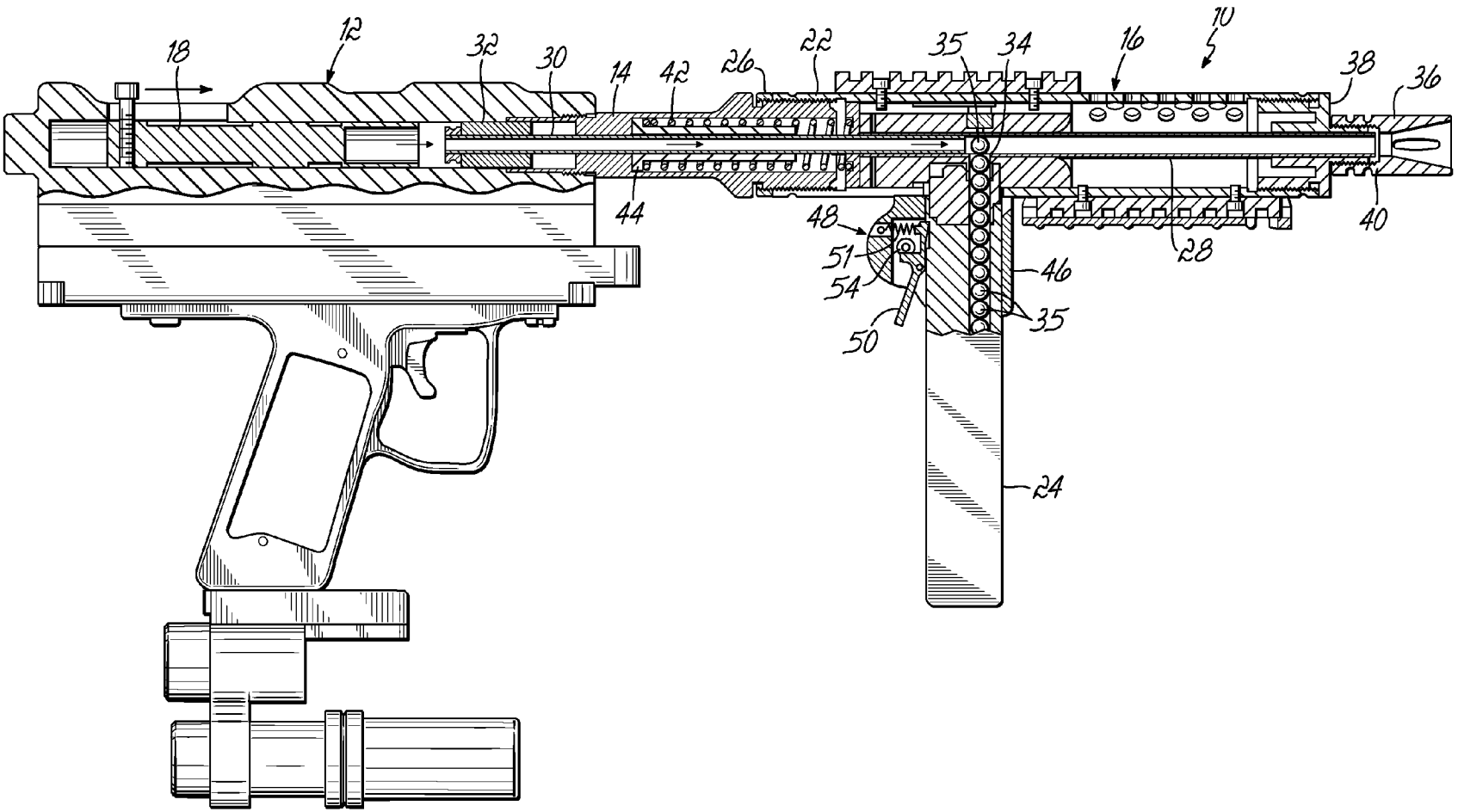
FIG. 3A is a partial cross-sectional view of the paintball marker conversion unit and conventional paintball marker of FIG. 1 shown with a projectile in the barrel and the tube fully retracted.

Referring now to FIGS. 2 and 3A, an indirect drive embodiment of projectile staging mechanism 16 of the present invention is illustrated. A receiver 22 is the main housing for the components of the direct drive embodiment of projectile staging mechanism 16. One end of adapter 14 is threaded and is screwed into receiver 22 of the indirect drive embodiment of projectile staging mechanism 16. The threaded mating surface between adapter 14 and receiver 22 allows the entire indirect drive embodiment of projectile staging mechanism 16 to be rotated and fixed at any angle relative to the longitudinal firing axis of paintball marker 12 thereby offering a variety of different shooting styles/options for the operator. For example, the projectile staging mechanism 16 can be rotated or angled to allow magazine 24 to feed in a vertical, horizontal, or other angular position. The projectile staging mechanism 16 is threaded onto adapter 14 until the desired angle between the projectile staging mechanism 16 and the paintball marker 12 has been achieved, then a retaining ring 26 on adapter 14 is tightened against projectile staging mechanism 16 to hold projectile staging mechanism 16 at the desired angle.

Figures 3B, 3D:
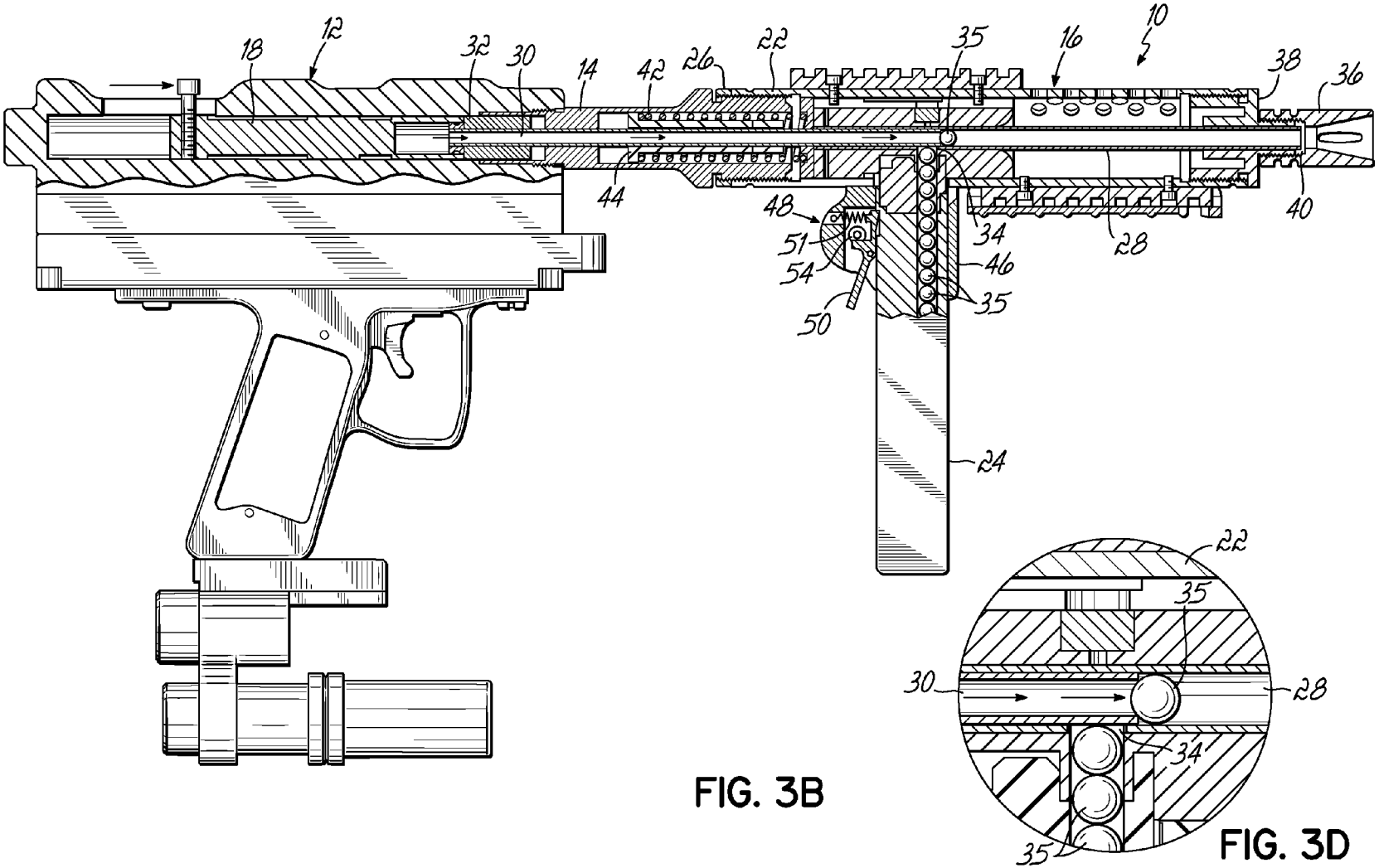
FIG. 3B is a partial cross-sectional view of the paintball marker conversion unit and conventional paintball marker of FIG. 3A shown with the tube contacting the projectile and covering the projectile inlet hole.
FIG. 3D is cross-sectional view of the tube contacting the projectile and covering the projectile inlet hole.
Figure 3C:
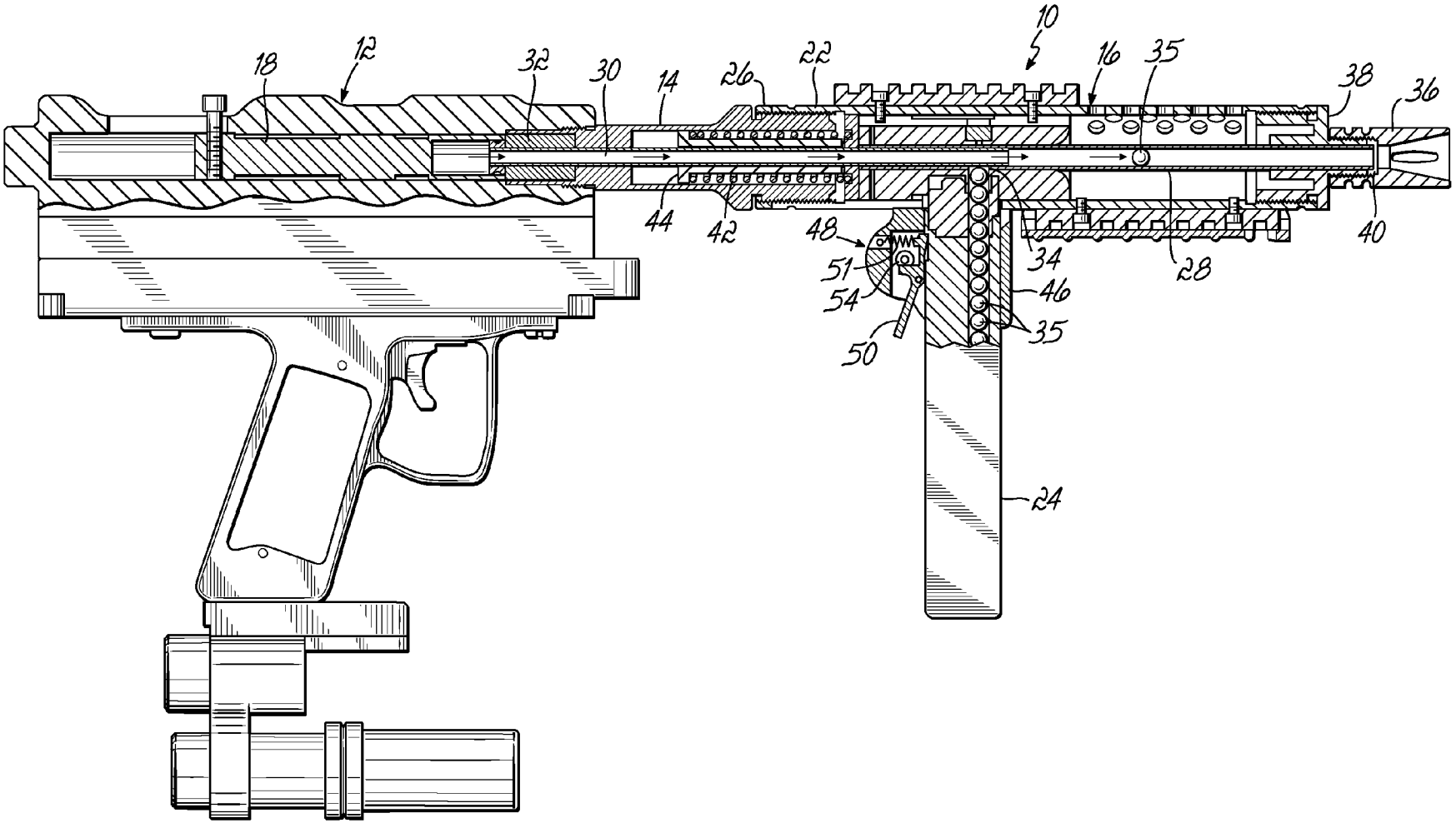
FIG. 3C is a partial cross-sectional view of the paintball marker conversion unit and conventional paintball marker of FIG. 3A shown with the tube in its forward most position and the projectile traveling down the barrel.
Figure 4:
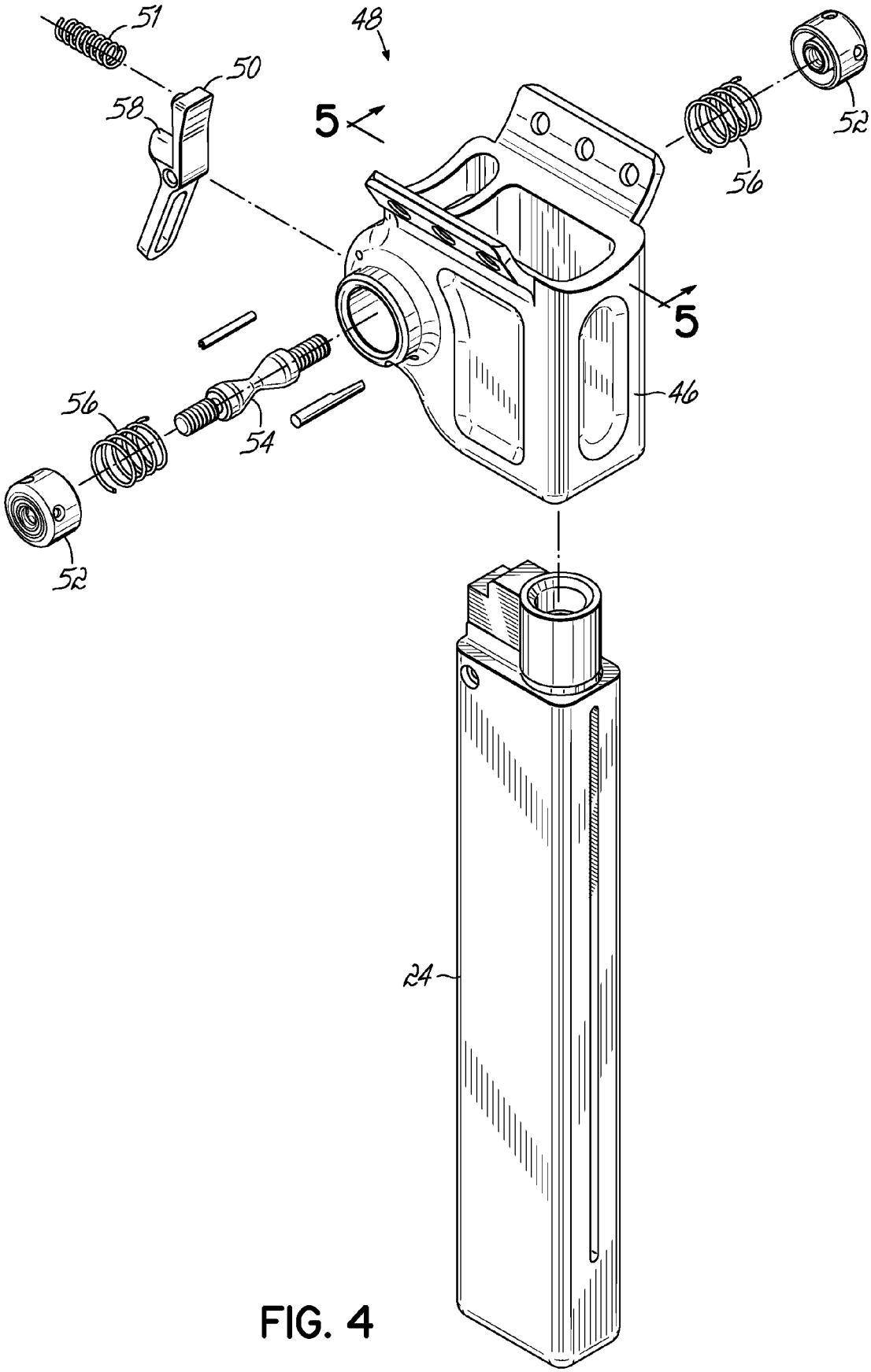
FIG. 4 is a disassembled perspective view of the magazine with a three-way release mechanism.
Figure 5:
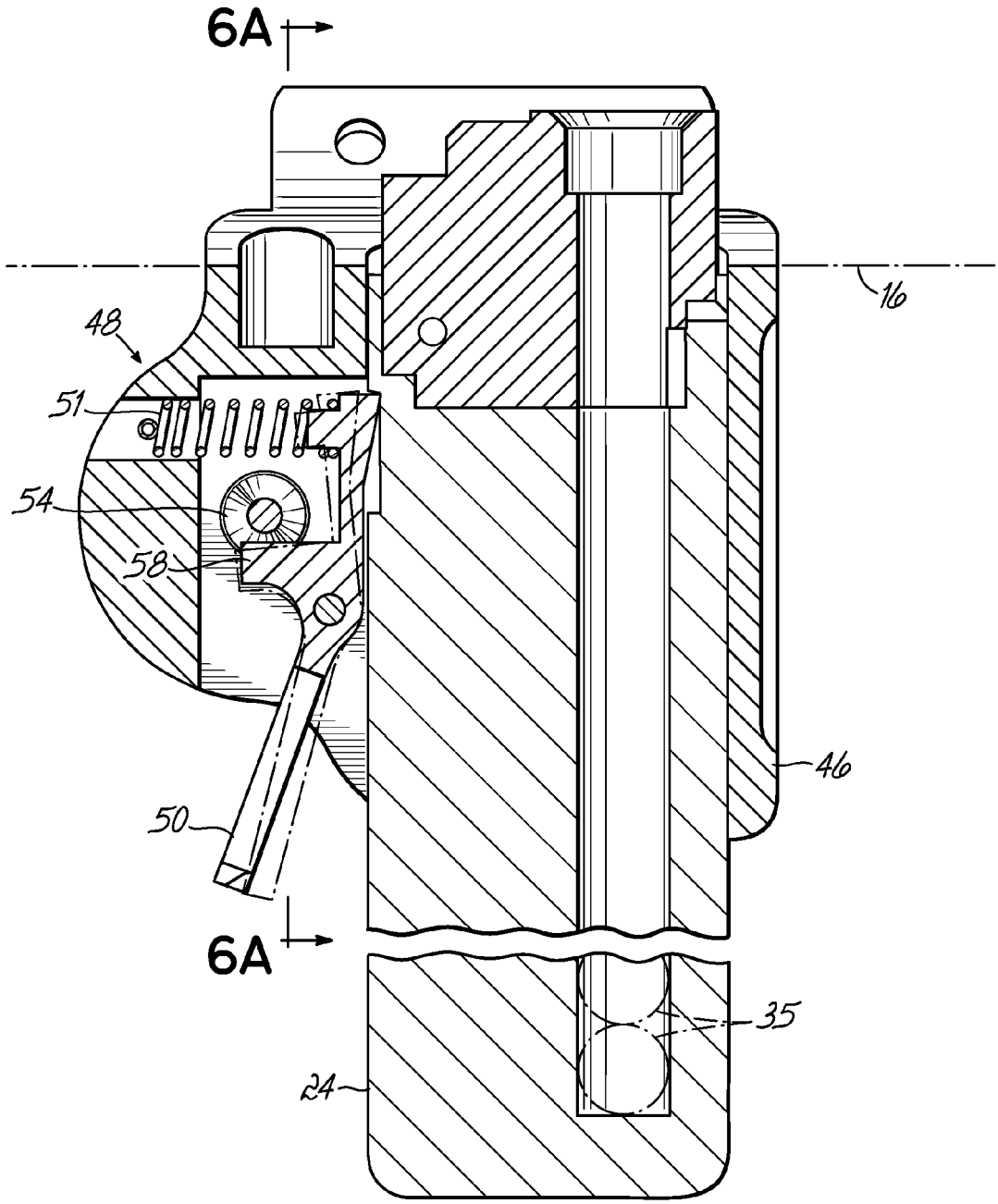
FIG. 5 is a cross-sectional view of the magazine of FIG. 4 taken along line 5-5.
Figure 6A:
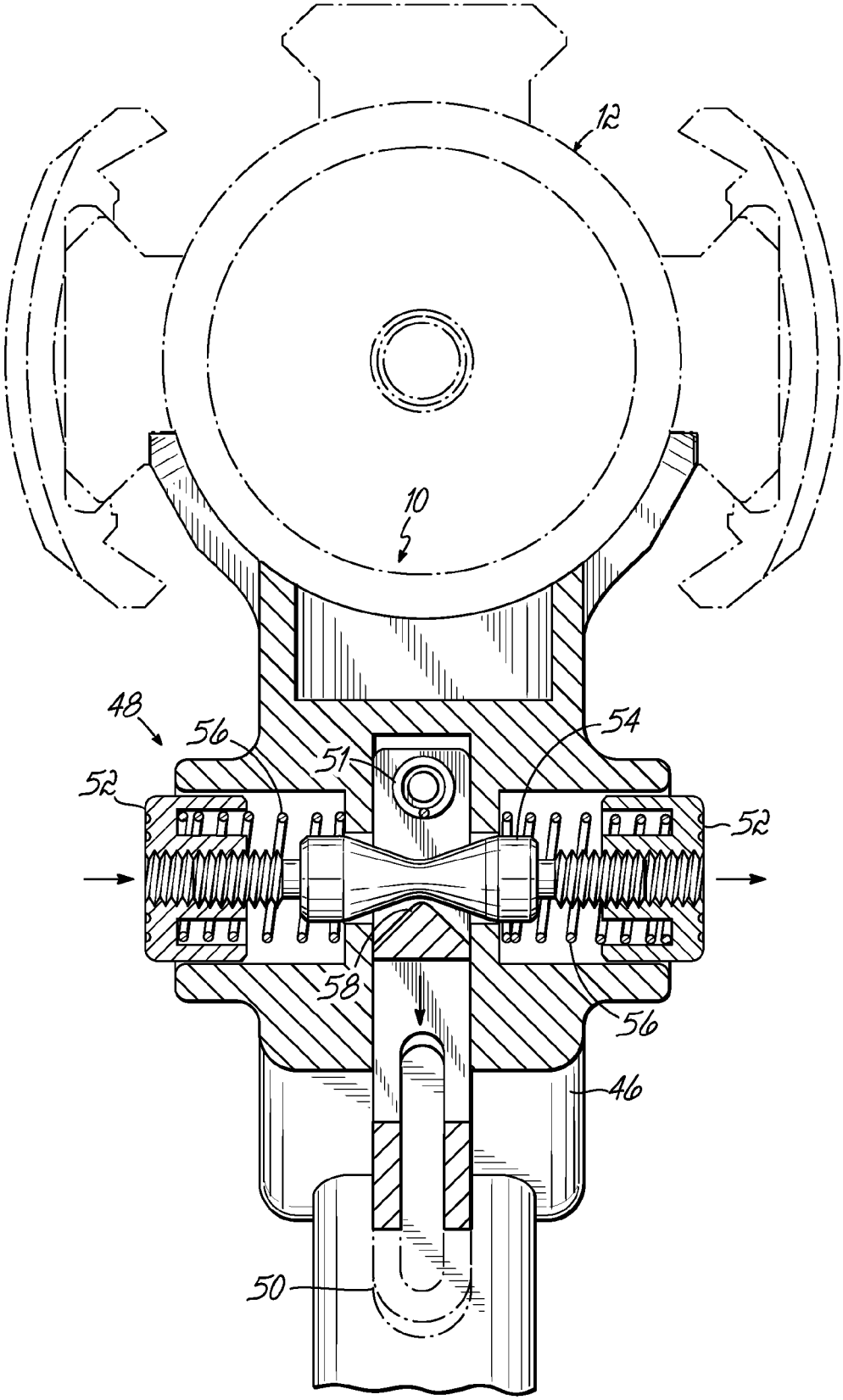
FIG. 6A is a cross-sectional view of the magazine of FIG. 5 taken along line 6A-6A of FIG. 5.
Figure 6B:
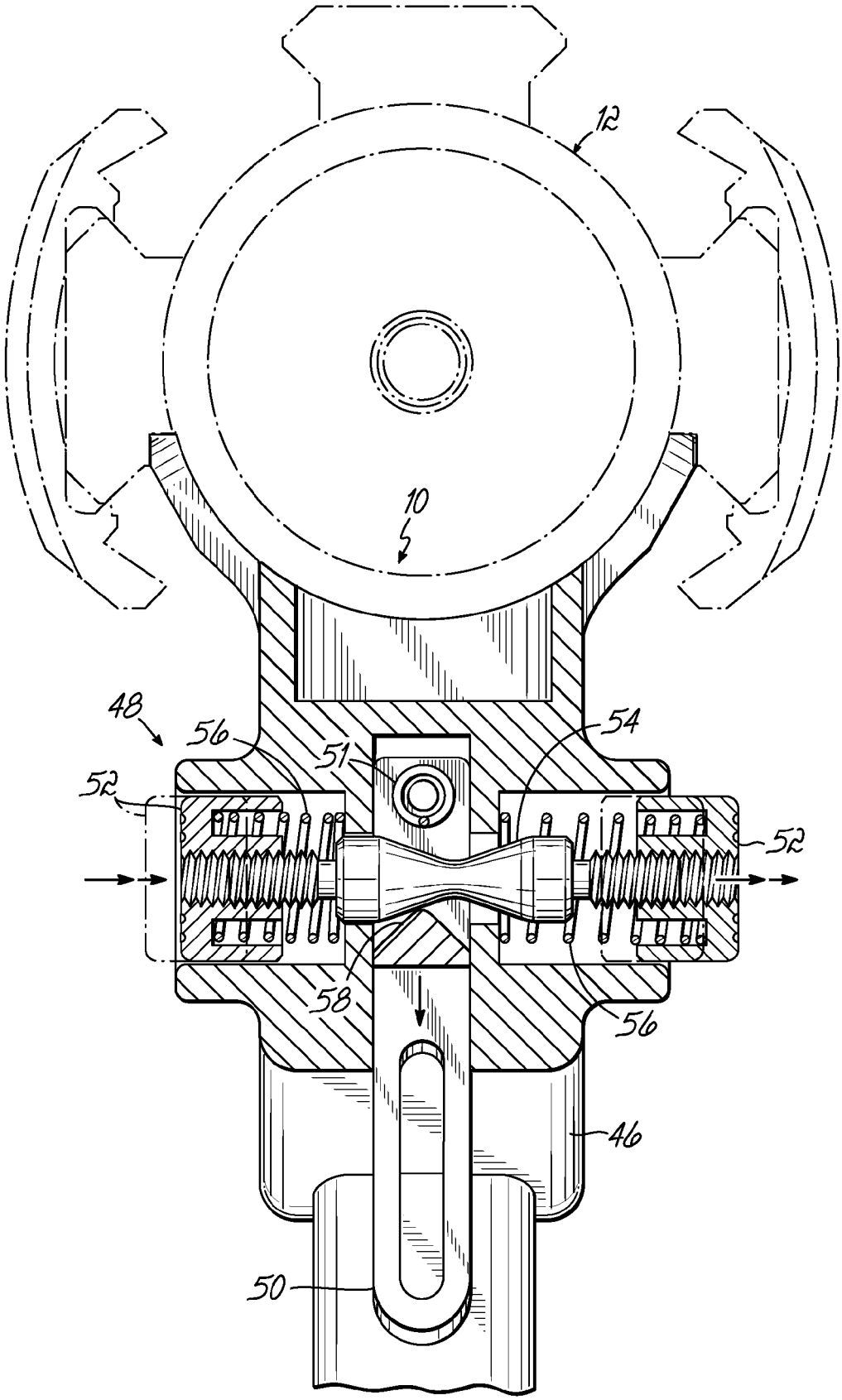
FIG. 6B is a cross-sectional view similar to FIG. 6A showing the magazine retaining mechanism in a released position.

The projectile staging mechanism 16 includes a barrel 28 and a tube 30. Tube 30 and barrel 28 work in concert to facilitate firing of a projectile. In this embodiment, tube 30 is coupled to tube bolt adapter 32, which abuts bolt 18 of paintball marker 12 to create a pressure seal therewith. As such, when bolt 18 moves forward, so does tube 30. A recuperator spring 42 and recuperator spring guide 44 bias the tube bolt adapter 32 to a rearward position (FIG. 3A) but not necessarily into bolt 18. Recuperator spring 42 returns the tube 30 to its pre-firing position. When the trigger of paintball marker 12 is pulled, the paintball marker's recoil spring forces bolt 18 forward, and thusly tube 30 forward. With further reference to FIGS. 3B and 3D, barrel 28 includes a projectile inlet hole 34 from which projectiles 35 are received from the magazine 24. The diameter of tube 30 may be larger or smaller than barrel 28. When tube 30 is brought forward by bolt 18, tube 30 slides along an interior surface of the barrel 28 (in the case where tube 30 has a smaller diameter than barrel 28) and over projectile inlet hole 34 to create an airtight seal therewith. Projectile inlet hole 34 is located in the sidewall of the barrel 28 to receive projectiles 35 being held in the magazine 24. The tight seal enables essentially all of the compressed gas to fire the projectile 35 out of the projectile staging mechanism 16. At rest, bolt 18 is held to the rear until the operator pulls the trigger. When the trigger is pulled, bolt 18 is released and propelled forward toward the muzzle via a compression spring (not shown). Bolt 18 and tube 30 travel forward to advance the next projectile 35 presented in barrel 28. Then, the paintball marker 12 releases compressed gas to propel the round out of barrel 28. Advantageously, the tube 30 pushes the projectile forward and seals the projectile inlet hole 34 prior to the release of the compressed gas. Consequently, essentially all of the compressed gas is available to fire the projectile 35 with greater force than if the projectile inlet hole 34 was left unsealed. Once bolt 18 and tube 30 has traveled approximately one inch, the bolt 18 depresses a main valve in paintball marker 12 thereby releasing a fixed quantity of high-pressure gas, just as it would if it were firing a standard paintball projectile. The compressed gas travels through bolt 18 and then tube 30. The gas exits the end of tube 30 where it impacts and accelerates the projectile 35 down barrel 28. See FIG. 3C. The compressed gas also acts against bolt 18 and tube 30 causing them to recoil rearward and return to their rest position until the whole process is started over again when the operator pulls the trigger.

Different barrels may be used with the projectile staging mechanism 16 to accommodate the different sized projectiles thus making the projectile staging mechanism 16 a multi-caliber system. Barrel 28 can be readily removed and replaced by a different barrel simply by unscrewing it from a barrel-retaining device 36, which is secured to the end of front barrel support 38. Besides threads, barrel-retaining device 36 may also be secured via an O-ring that is compressed by barrel retaining device 36 and a flange 40 on the front end of the barrel 28.

The magazine 24 may be any commercial off the shelf device. Different magazines may be used to accommodate different sized projectiles. Such projectiles may include, but are not limited to, .177 caliber BBs, .177 caliber pellets, .25 caliber ball bearings, 6 mm airsoft rounds, and any other small caliber ammunition. The term "magazine" can also include any type of feed mechanism referred to as a "drum," "stick magazine," "box magazine," "gravity feed," or any such similar term.

Referring now to FIGS. 3A-6B, the magazine well 46 holds the magazine 24 in position to correctly present the leading projectile 35 in magazine 24 into the projectile staging mechanism 16. Magazine well 46 not only holds the magazine 24, but also secures or retains it in position via a magazine retaining mechanism 48. Magazine retaining mechanism 48 provides the operator with two different options for releasing magazine 24 from the magazine well 46. The first option removing the magazine 24 is to activate the lever 50. Lever 50 is biased to its rest position via a compression spring 51, which engages lever 50 in a cutout in magazine 24 and thus prevents its removal from magazine well 46. The second option removing the magazine 24 is to push either of the magazine release buttons 52 located on either side of magazine well 46. Magazine release buttons 52 can be captured via an hourglass shaped rod 54 that runs from either side of magazine well 46. Magazine release buttons 52 can be biased to their rest position, i.e., the centerline of magazine well 46, via compression springs 56. When either of the magazine release buttons 52 are pushed hour-glass shaped rod 54 moves toward center line of magazine well 46 where the increasing diameter of the hour-glass shaped rod 54 applies a downward force onto a rearward protruding arm 58 of lever 50. This downward force on lever 50 disengages magazine 24 from the magazine well 46.

Figure 7A:
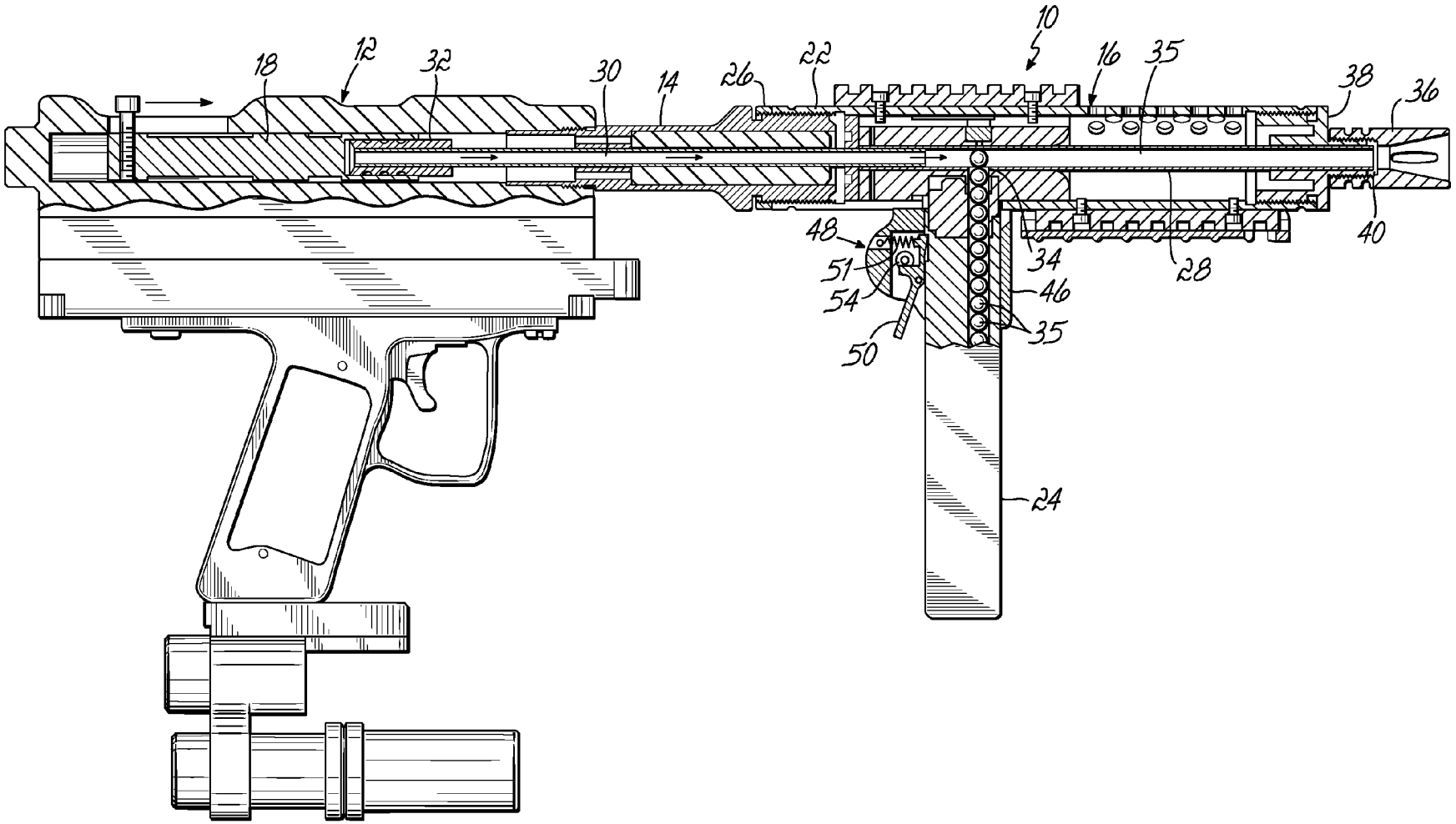
FIG. 7A is a partial cross-sectional view of another embodiment of a paintball marker conversion unit and conventional paintball marker shown with a projectile in the chamber and the tube fully retracted.

Referring now to FIG. 7A, a direct drive embodiment of projectile staging mechanism 16 of the invention is illustrated. All aspects of this embodiment are similar to that of projectile staging mechanism 16 in FIGS. 2 and 3A with differences noted below. The direct drive embodiment of projectile staging mechanism 16 utilizes a tube 30 like the indirect drive embodiment of projectile staging mechanism 16 (FIG. 2); however, in this particular embodiment tube 30 and tube bolt adapter 32 are not biased toward bolt 18 via a recuperator spring. Instead, tube bolt adapter 32 removeably connects, by threads for example, to and moves with bolt 18. Because tube bolt adapter 32 is connected to bolt 18, a recuperator spring is not required. In the direct drive embodiment, the relationship between tube 30 and barrel 28 are the same as in the indirect drive embodiment of projectile staging mechanism 16.

Figure 7B:
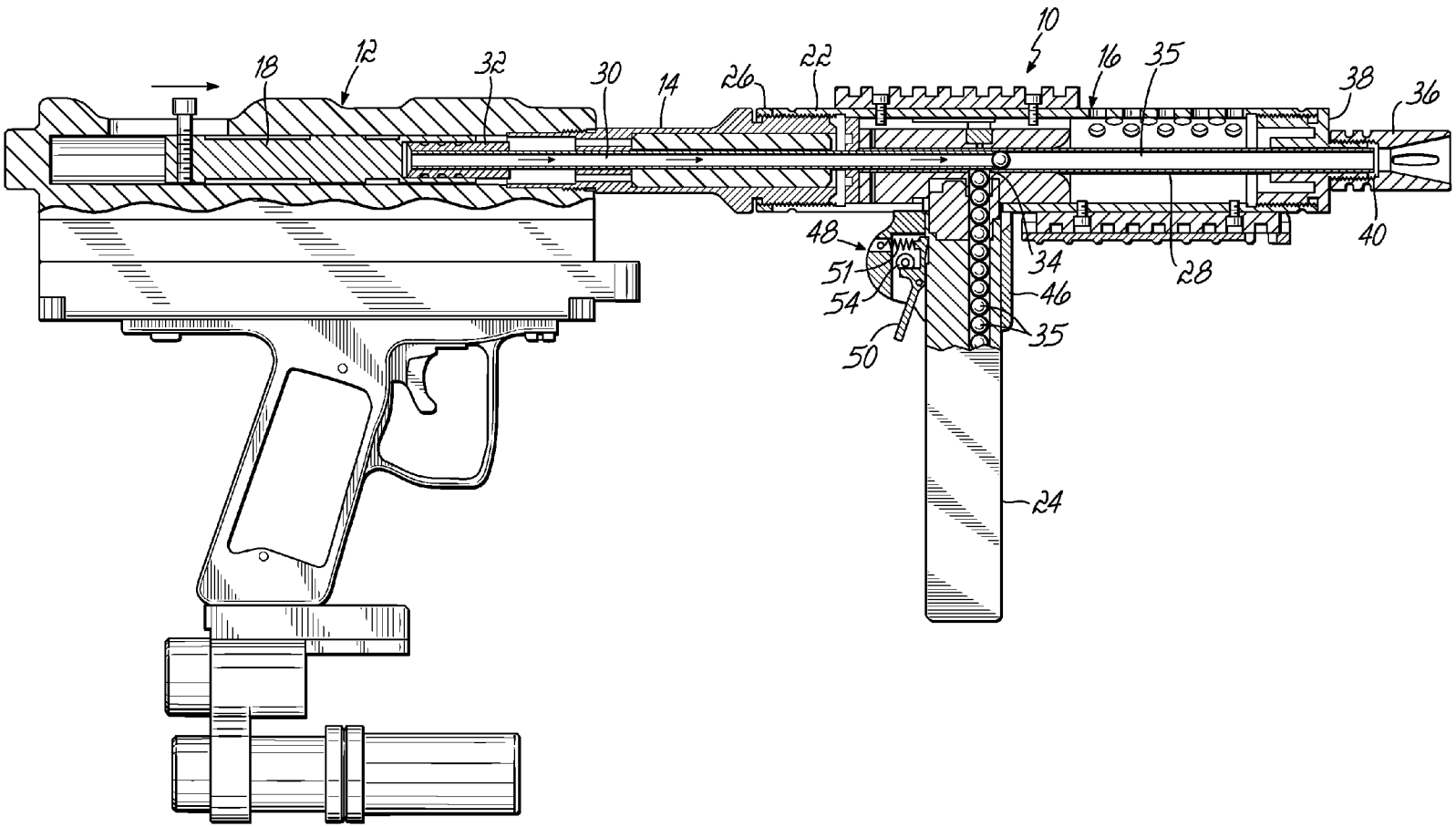
FIG. 7B is a partial cross-sectional view of the paintball marker conversion unit and conventional paintball marker of FIG. 7A shown with the tube contacting the projectile and covering the projectile inlet hole.
Figure 7C:
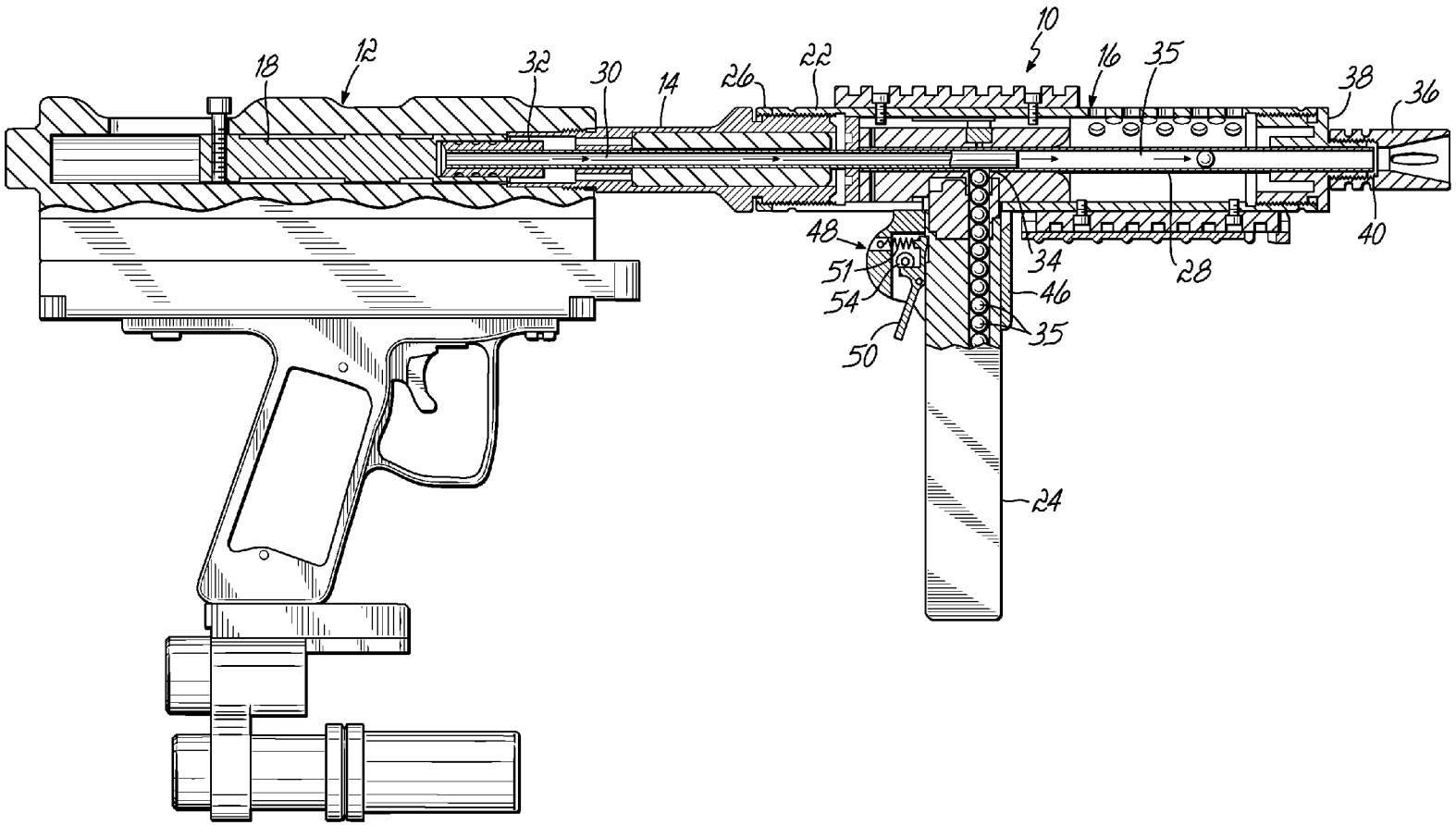
FIG. 7C is a partial cross-sectional view of the paintball marker conversion unit and conventional paintball marker of FIG. 7A shown with the tube in its forward most position and the projectile traveling down the barrel.

FIG. 7B shows the direct drive embodiment with the tube 30 brought forward by bolt 18 and slid over the rearward end of barrel 28 and over projectile inlet hole 34 to create an airtight seal therewith. FIG. 7B is similar to FIG. 3B for the indirect embodiment. FIG. 7C shows the tube 30 at its forward most position and the compressed gas pushing the projectile 35 down the barrel 28. FIG. 7B is similar to FIG. 3C for the indirect embodiment.

Figure 8A:
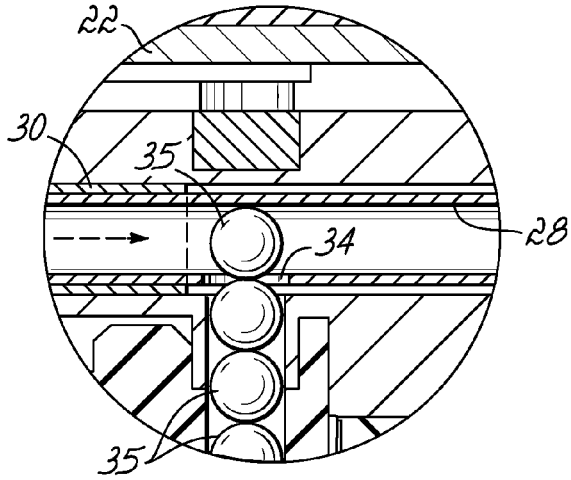
FIG. 8A is an enlarged cross-sectional view of the tube sliding over the barrel just prior to covering the projectile inlet hole.
Figure 8B:
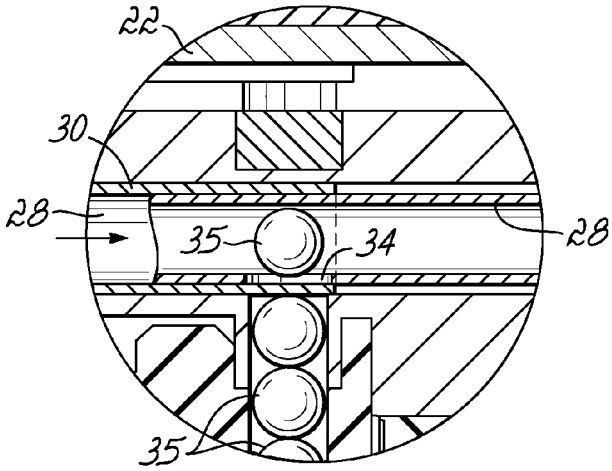
FIG. 8B is an enlarged cross-sectional view of the tube sliding over the barrel and covering the projectile inlet hole.
Figure 8C:
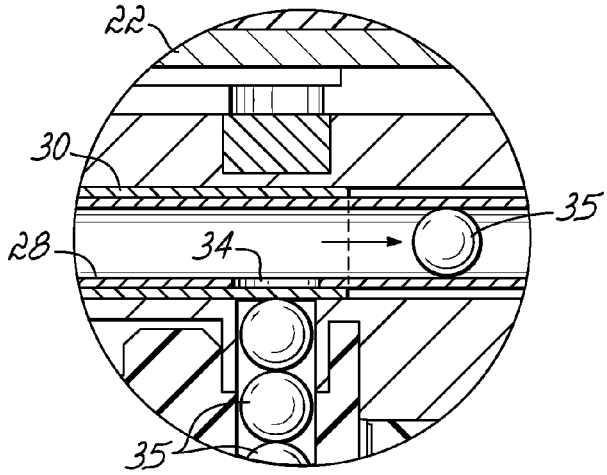
FIG. 8C is an enlarged cross-sectional view of the tube sliding over the barrel and the projectile advancing down the barrel.

The embodiments shown in FIGS. 3A and 7A, illustrate the tube 30 with a diameter smaller than barrel 28. As such, tube 30 slides along the interior surface of barrel 28 when the paintball marker 12 is fired. As mentioned above, in other embodiments the diameter of tube 30 may be larger than the diameter of barrel 28. In that situation, the tube 30 would slide along an exterior surface of the barrel 28. FIGS. 8A-8C illustrate this configuration. Other than the increased diameter of the tube 30, the structural and operational aspect of the paintball marker conversion unit 10 remain largely unchanged. As shown in FIG. 8B, the tube 30 covers up projectile inlet hole 34 of barrel 28 to create an essentially airtight seal. In addition, because the tube 30 slides along the exterior surface of the barrel 28, the tube 30 does not contact the projectile 35 during the firing process.

While the present invention has been illustrated by a description of embodiments and while these embodiments have been described in some detail, it is not the intention of the Applicants to restrict or in any way limit the scope of the appended claims to such detail. Additional advantages and modifications other than those specifically mentioned herein will readily appear to those skilled in the art.

What is claimed is:

1. A paintball marker conversion unit comprising:

a projectile staging mechanism having a barrel with a projectile inlet hole position along a sidewall of the barrel, the projectile staging mechanism having an attachment end;

an adapter having first and second ends, the first end being selectively removeably coupled to the attachment end of the projectile staging mechanism, the second end being configured to selectively removeably couple to a paintball marker, the adapter further having a tube with a first end slideably engaging the barrel of the projectile staging mechanism and a second end configured to engage the paintball marker when the adapter is coupled to the paintball marker wherein when a trigger of the paintball marker is activated the tube moves forward to generally seal the projectile inlet hole and allow pressurized gas from the paintball marker to discharge the projectile out of the barrel.

2. The paintball marker conversion unit of claim 1, wherein the first and second ends of the adapter are threaded.

3. The paintball marker conversion unit of claim 1, wherein the first end of the adapter includes a retaining ring to rotatingly fix the adapter to the attachment end of the projectile staging mechanism.

4. The paintball marker conversion unit of claim 1, wherein the projectile staging mechanism further includes a magazine well for receiving and retaining a magazine for holding projectiles.

5. The paintball marker conversion unit of claim 4, wherein the magazine well includes a magazine retaining mechanism that is selectively moveable to release a magazine retained in the magazine well.

6. The paintball marker conversion unit of claim 5, wherein the magazine retaining mechanism includes a lever and oppositely disposed buttons, either of which may be operated to release a magazine from the magazine well.

7. The paintball marker conversion unit of claim 1, wherein the barrel has a first diameter and the tube has a second diameter, the first diameter being greater than the second diameter such that the tube may slide along an interior surface of the barrel.

8. The paintball marker conversion unit of claim 1, wherein the barrel has a first diameter and the tube has a second diameter, the first diameter being less than the second diameter such that the tube may slide along an exterior surface of the barrel.

9. The paintball marker conversion unit of claim 1, wherein the adapter further includes a bias member operatively coupled to the tube so as to bias the tube rearwardly toward the paintball marker when the adapter is coupled to the paintball marker.

10. The paintball marker conversion unit of claim 9, wherein the bias member is a spring.

11. The paintball marker conversion unit of claim 1, wherein the tube includes a tube bolt adapter with a threaded end, the threaded end may be selectively removeably coupled to a bolt of the paintball marker when the adapter is coupled to the paintball marker, the tube moving with the action of the bolt when the paintball marker is fired.

12. A paintball marker conversion unit comprising:

a projectile staging mechanism having a barrel with a projectile inlet hole position along a sidewall of the barrel, the projectile staging mechanism having an attachment end; and an adapter having first and second threaded ends, the first end being selectively removeably coupled to the attachment end of the projectile staging mechanism, the second end being configured to selectively removeably couple to a paintball marker, the adapter further having a tube with a first end slideably engaging the barrel of the projectile staging mechanism and a second end configured to engage the paintball marker when the adapter is coupled to the paintball marker, the adapter including a bias member operatively coupled to the tube so as to bias the tube rearwardly;

wherein when a trigger of the paintball marker is activated the tube moves forward to generally seal the projectile inlet hole and allow pressurized gas from the paintball marker to discharge the projectile out of the barrel.

13. The paintball marker conversion unit of claim 12 wherein the projectile staging mechanism further includes a magazine well for receiving and retaining a magazine for holding projectiles.

14. The paintball marker conversion unit of claim 13, wherein the magazine well includes a magazine retaining mechanism that is selectively moveable to release a magazine retained in the magazine well.

15. The paintball marker conversion unit of claim 14, wherein the magazine retaining mechanism includes a lever and oppositely disposed buttons, either of which may be operated to release a magazine from the magazine well.

16. A paintball marker conversion unit comprising:

a projectile staging mechanism having a barrel with a projectile inlet hole position along a sidewall of the barrel, the projectile staging mechanism having an attachment end; and an adapter having first and second threaded ends, the first end being selectively removeably coupled to the attachment end of the projectile staging mechanism, the second end being configured to selectively removeably couple to a paintball marker, the adapter further having a tube with a first end slideably engaging the barrel of the projectile staging mechanism and a second end configured to engage the paintball marker when the adapter is coupled to the paintball marker, wherein the tube includes a tube bolt adapter with a threaded end, the threaded end may be selectively removeably coupled to a bolt of the paintball marker;

wherein when a trigger of the paintball marker is activated the tube moves forward to generally seal the projectile inlet hole and allow pressurized gas from the paintball marker to discharge the projectile out of the barrel.

17. The paintball marker conversion unit of claim 16, wherein the projectile staging mechanism further includes a magazine well for receiving and retaining a magazine for holding projectiles.

18. The paintball marker conversion unit of claim 17, wherein the magazine well includes a magazine retaining mechanism that is selectively moveable to release a magazine retained in the magazine well.

19. The paintball marker conversion unit of claim 18, wherein the magazine retaining mechanism includes a lever and oppositely disposed buttons, either of which may be operated to release a magazine from the magazine well.

* * * * *